US011317747B2

(12) United States Patent
Strassburger et al.

(10) Patent No.: US 11,317,747 B2
(45) Date of Patent: May 3, 2022

(54) ONE-PIECE DISPLAY HANGER FOR SLIDE STYLE SHOES

(71) Applicant: B&G International Products Ltd., Kowloon (HK)

(72) Inventors: Jacob Strassburger, South Plainfield, NJ (US); Michael Norman, East Brunswick, NJ (US)

(73) Assignee: B&G International Products Ltd., Kowloon (HK)

( * ) Notice: Subject to any disclaimer, the term of this patent is extended or adjusted under 35 U.S.C. 154(b) by 109 days.

(21) Appl. No.: 16/990,481

(22) Filed: Aug. 11, 2020

(65) Prior Publication Data

US 2021/0045560 A1 Feb. 18, 2021

Related U.S. Application Data

(60) Provisional application No. 62/886,447, filed on Aug. 14, 2019.

(51) Int. Cl.

| | |
|---|---|
| ***A47G 25/18*** | (2006.01) |
| ***A47G 25/40*** | (2006.01) |
| ***A47G 25/36*** | (2006.01) |
| ***A47G 25/14*** | (2006.01) |

(52) U.S. Cl.

CPC ..... *A47G 25/18* (2013.01); *A47G 25/36* (2013.01); *A47G 25/40* (2013.01); *A47G 25/1435* (2013.01)

(58) Field of Classification Search

CPC ..... A47G 25/005; A47G 25/36; A47G 25/60; A47G 25/40; A47G 25/14; E05B 69/003; A47F 7/08

USPC ..... 211/34; 223/85, 87, 89, 94

See application file for complete search history.

(56) References Cited

U.S. PATENT DOCUMENTS

| | | | | | |
|---|---|---|---|---|---|
| D82,948 | S | * | 12/1930 | Livingston | D6/318 |
| 3,860,154 | A | * | 1/1975 | Atkins | A47G 25/183 211/113 |
| D279,627 | S | * | 7/1985 | Morin | D6/315 |
| 4,576,290 | A | * | 3/1986 | Zigman | A47G 25/005 248/316.5 |
| 4,714,156 | A | | 12/1987 | Kolton et al. | |
| 4,765,467 | A | * | 8/1988 | Kolton | A47G 25/743 211/113 |
| 4,768,649 | A | | 9/1988 | Kolton et al. | |
| 4,930,692 | A | | 6/1990 | Smilow et al. | |

(Continued)

*Primary Examiner* — Nathan E Durham

(74) *Attorney, Agent, or Firm* — Hoffmann & Baron, LLP

(57) ABSTRACT

A display hanger for slides includes a body member and a holder configured to be integrally connected to the body member. The body member includes a display hanger hook, an elongated central member connected to the display hanger hook, and opposed first and second shoulders connected to the central member. Each of the first and second shoulders extends laterally from a lower end of the central member and extends downwardly such that a holder space is formed between the first and second shoulders. The holder has parallel first and second longitudinal side walls and parallel first and second transverse side walls. The longitudinal side walls and transverse side walls are integrally connected to each other to form a generally rectangular frame having an open space in the middle. The display hanger further includes an elastic cord for keeping the slides with the display hanger while a customer tries them on.

14 Claims, 5 Drawing Sheets

(56) References Cited

U.S. PATENT DOCUMENTS 4,932,571 A * 6/1990 Blanchard ..... A47G 25/16 223/89
5,110,019 A 5/1992 Kolton et al.
5,123,577 A 6/1992 Kolton et al.
5,222,638 A 6/1993 Kolton et al.
5,328,065 A 7/1994 Kolton et al.
5,501,378 A 3/1996 Kolton et al.
5,582,387 A 12/1996 Kolton et al.
5,615,810 A 4/1997 Kolton et al.
5,826,760 A 10/1998 Kolton et al.
5,975,384 A * 11/1999 Manabat ..... A47G 25/485 223/91
5,988,462 A 11/1999 Kolton
6,073,758 A 6/2000 Webster et al.
6,094,848 A * 8/2000 Heath ..... G09F 3/20 40/322
6,206,253 B1 3/2001 Kolton et al.
6,244,478 B1 * 6/2001 Lee ..... A47G 25/485 223/89
6,264,077 B1 7/2001 Kolton et al.
6,561,358 B2 5/2003 Kolton et al.
7,143,892 B2 12/2006 Kolton et al.
7,448,520 B2 11/2008 Kolton et al.
8,286,882 B2 10/2012 Norman et al.
8,308,291 B2 11/2012 Norman et al.
8,651,344 B2 2/2014 Norman et al.
9,480,347 B2 11/2016 Strassburger et al.
9,492,021 B2 * 11/2016 Kebreau ..... A45D 44/00
9,585,496 B2 3/2017 Strassburger et al.
2003/0136805 A1 * 7/2003 Shwartz ..... A47G 25/10 223/85
2013/0200113 A1 * 8/2013 Tashkin ..... A47G 25/40 223/85
2016/0058209 A1 3/2016 Strassburger et al.
2017/0253408 A1 9/2017 Strassburger
2018/0087293 A1 3/2018 Strassburger et al.
2019/0239658 A1 8/2019 Strassburger et al.
2020/0093307 A1 3/2020 Strassburger

* cited by examiner

ONE-PIECE DISPLAY HANGER FOR SLIDE STYLE SHOES

CROSS-REFERENCE TO RELATED APPLICATION

This application claims priority to U.S. Provisional Patent Application No. 62/886,447, filed on Aug. 14, 2019, the contents of which are incorporated herein by reference in its entirety.

FIELD OF THE INVENTION

The present invention relates to display hangers, and more particularly, to display hangers configured to accommodate and display slide style shoes.

BACKGROUND OF THE INVENTION

In most retail footwear stores, footwear products such as slides are commonly displayed for sale on shoe racks or hung on a hook or the like. Generally, the entire inventory of models and sizes of these footwear products are available in the showroom for customers. It is customary for the customers to try different models and sizes of their choices in the showroom. However, this presents an issue of mixing up of the footwear products since the footwear products are frequently scattered randomly on the showroom floor after the customers try them on.

Accordingly, there is a need for an improved display hanger to prevent mix-up of models and sizes of slide style shoes.

SUMMARY OF THE INVENTION

According to an embodiment of the present invention, a display hanger for slides includes a body member and a holder configured to be integrally connected to the body member. The body member includes a display hanger hook, an elongated central member connected to the display hanger hook, and opposed first and second shoulders connected to the central member. Each of the first and second shoulders extends laterally from a lower end of the central member and extends downwardly such that a holder space is formed between the first and second shoulders. The holder has parallel first and second longitudinal side walls and parallel first and second transverse side walls. The longitudinal side walls and transverse side walls are integrally connected to each other to form a generally rectangular frame having an open space in the middle.

The display hanger further includes an elastic cord for keeping the slides with the display hanger while a customer tries them on.

These and other aspects of the present invention will be better understood in view of the drawings and following detailed description.

DETAILED DESCRIPTION OF PREFERRED EMBODIMENTS

Figure 1:
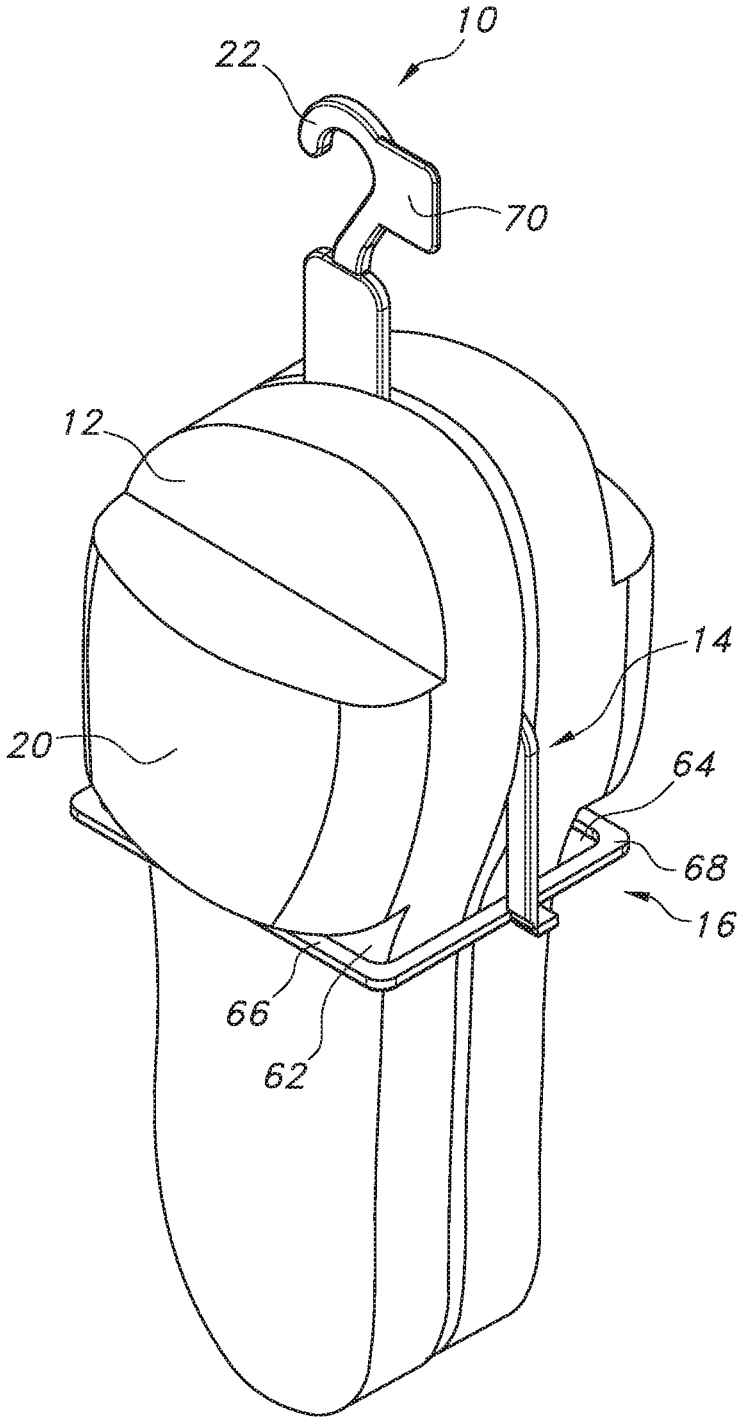
FIG. 1 is a front perspective view of the display hanger, according to an embodiment of the present invention, with slides placed thereonto.
Figure 2:
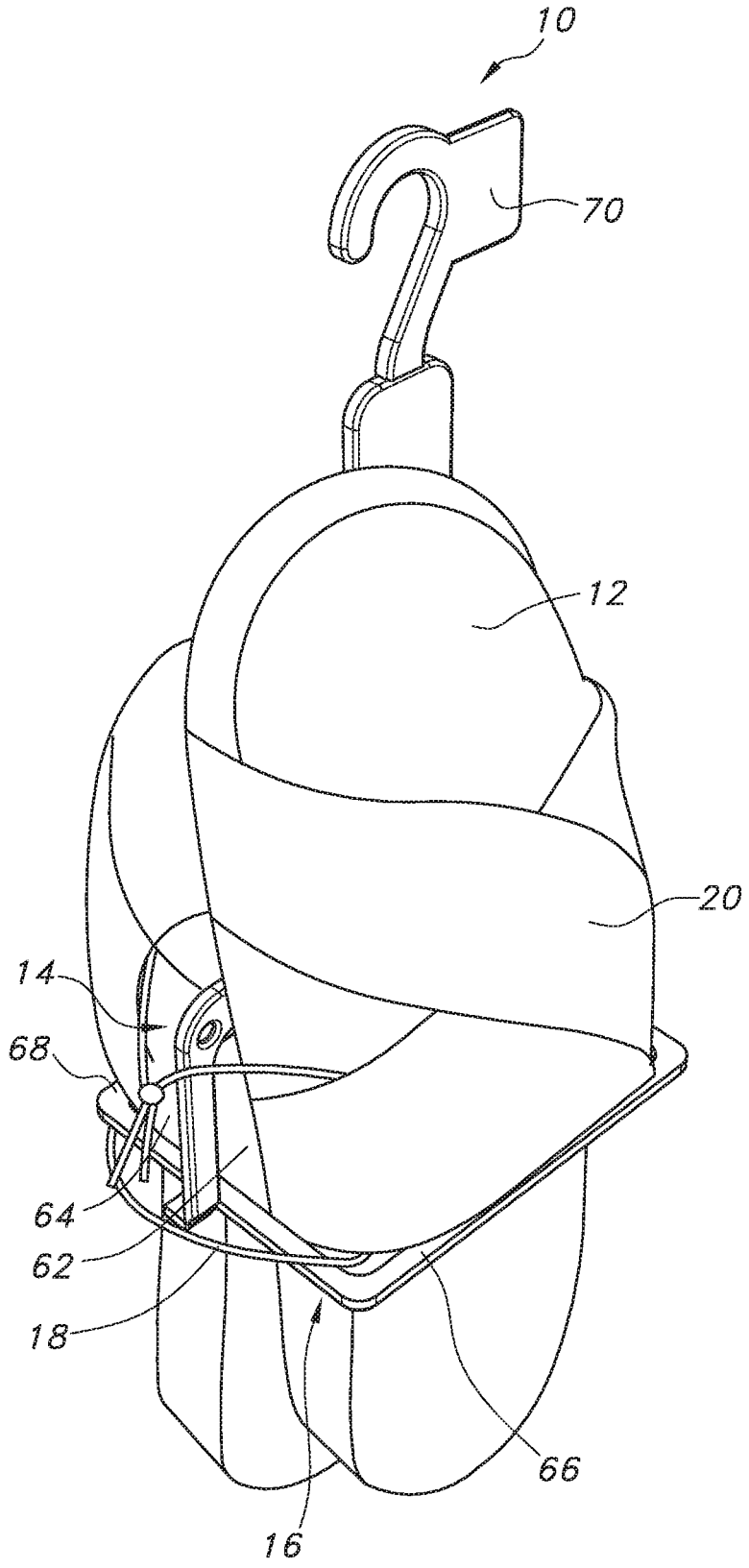
FIG. 2 is another front perspective view of the display hanger in FIG. 1, with slides placed thereonto.

According to an embodiment of the present invention, referring to FIGS. 1 and 2, there is shown a display hanger 10 configured to engage and accommodate a variety of different shoes, such as slides 12. The display hanger 10 is a one-piece structure, which includes a body member 14 and a holder 16 integrally connected to the body member 14, which will be described in greater detail below. The display hanger 10 further includes an elastic cord 18, such as a bungee cord, for keeping the slides 12 together with the display hanger 10 while a customer tries them on.

Directional terms, such as upper and lower are referenced to an orientation in which the display hanger 10, with straps 20 of the slides 12 engaged therewith, is hung on a display hook. However, the present invention is not thereby limited to use in any particular orientation.

Figure 3:
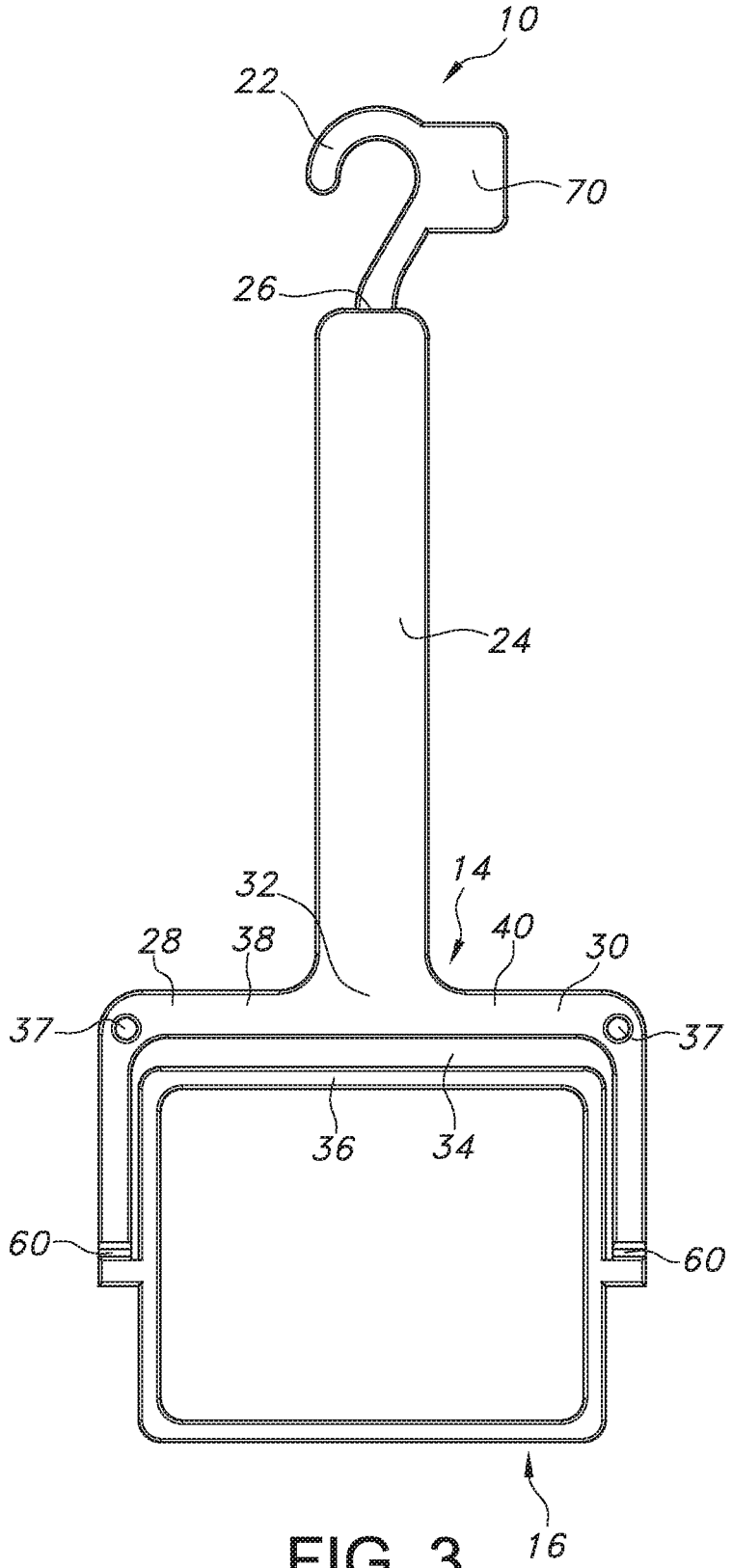
FIG. 3 is a front view of the display hanger in FIG. 1.
Figure 4:
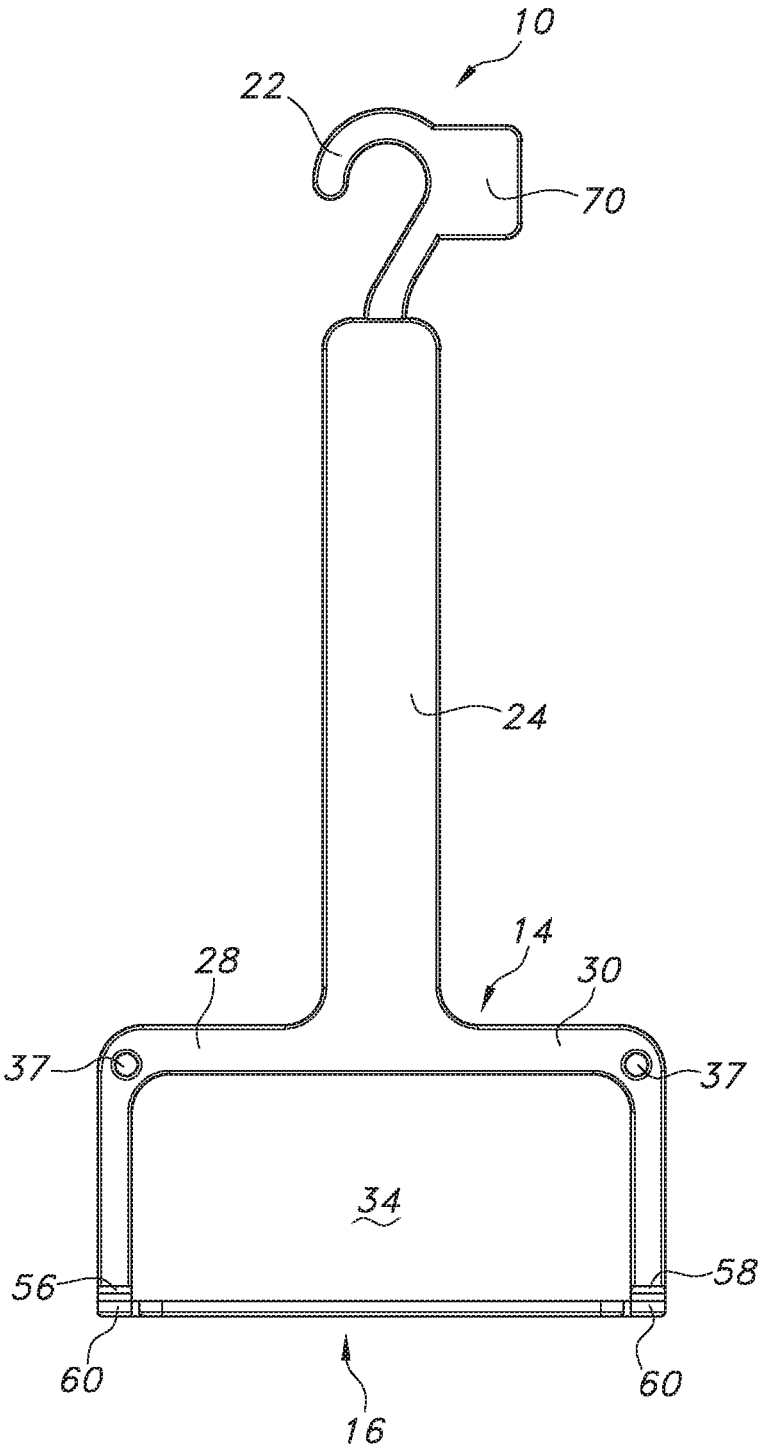
FIG. 4 is a front view of the body member of the display hanger in FIG. 1, with the holder being rotated.
Figure 5:
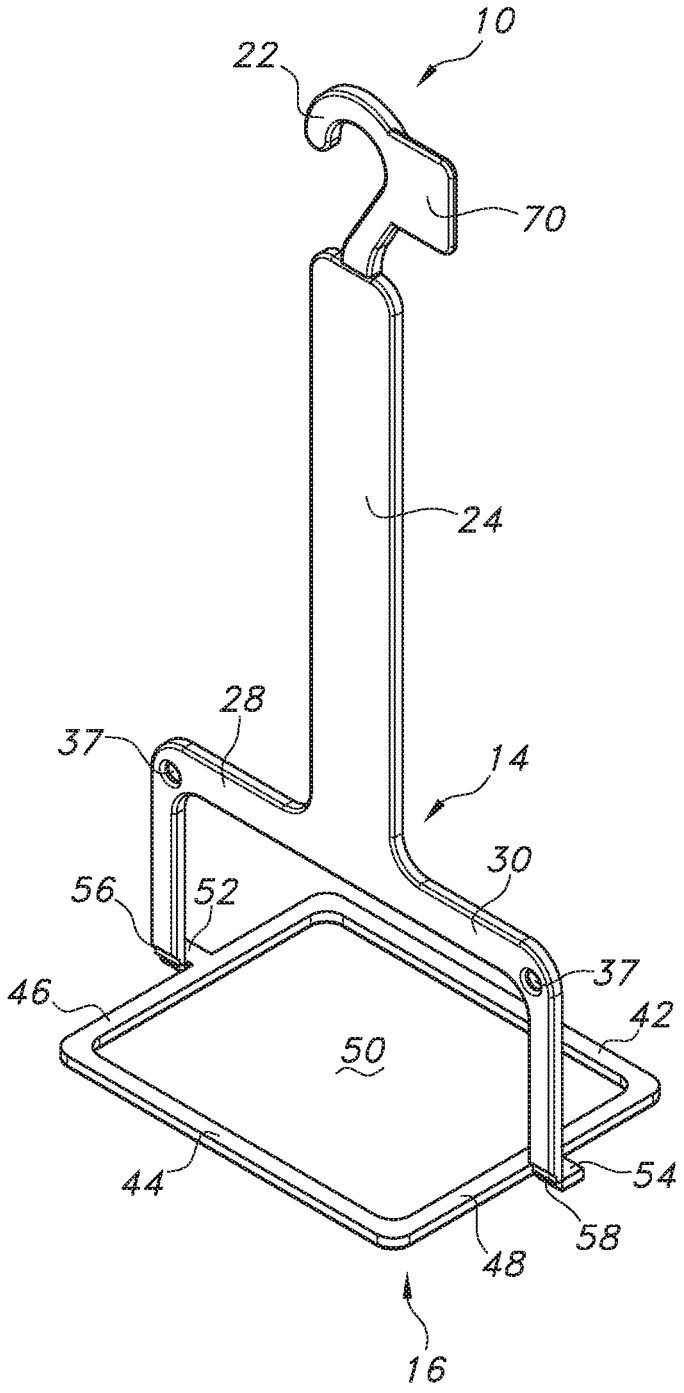
FIG. 5 is another front perspective view of the display hanger in FIG. 1.

Referring to FIGS. 3-5, the body member 14 includes a display hanger hook 22, a generally elongated central member 24 integrally connected to a lower end 26 of the display hanger hook 22 and extending downwardly therefrom, and opposed first and second shoulders 28, 30 integrally connected to a lower end 32 of the central member 24. The display hanger hook 22 is positioned directly above the central member 24 to provide a mean to engage with a display hook for retail display.

Each of the first and second shoulders 28, 30 extends laterally, to opposite direction to each other, from the lower end 32 of the central member 24 and then extends downwardly such that a holder space 34 is formed between the first and second shoulders 28, 30. The holder space 34 is dimensioned such that an upper portion 36 of the holder 16 could be accommodated therewithin, as shown in FIG. 3.

In the depicted embodiment, an aperture 37 is defined in an upper portion 38, 40 of each of the shoulders 28, 30, through which the elastic cord 18 may be inserted and tie the slides 12 to the display hanger 10. Tying of the slides 12 to the display hanger 10 allows a customer to take the slides 12 out from the display hanger 10 and try the slides 12 on without them being completely separated from the display hanger 10 or each other, as shown in FIG. 2. Alternatively, a plurality of apertures 37 may be defined on each of the first and second shoulders 28, 30 for the elastic cord 18 to be inserted and tie the slides 12 to the display hanger 10.

The holder 16 includes substantially parallel first and second longitudinal side walls 42, 44 and substantially parallel first and second transverse side walls 46, 48, with all the walls 42, 44, 46, 48 having the same thickness. The longitudinal side walls 42, 44 and transverse side walls 46, 48 of the holder 16 are integrally connected to each other, such that they form a generally rectangular frame having an open space 50 in the middle.

The holder 16 further includes opposed first and second tabs 52, 54 that extend outwardly from a center of each of the first and second transverse side walls 46, 48, respectively. The first tab 52 and second tab 54 allow the holder 16 to be attached to the body member 14. Specifically, as shown in FIGS. 3-5, the first and second tabs 52, 54 of the holder 16 are integrally connected to first and second ends 56, 58 of the shoulders 28, 30, respectively, via a foldline 60, such as crease. The foldlines 60 allow the upper portion 36 of the holder 16 to be rotated in and out of the holder space 34, as shown in FIG. 4.

The holder 16 is rotated out of the holder space 34 before securing the slides 12 to the display hanger 10. Specifically, the upper portion 36 of the holder 16 is rotated out from the holder space 34 to be in a position that is perpendicular to the body member 14 and shoulders 28, 30, as shown in FIGS. 4 and 5.

Referring again to FIG. 1, once the holder 16 is perpendicular to the body member 14 and first and second shoulders 28, 30, the open space 50 of the holder 16 is divided into two equal spaces 62, 64 by the body member 14 and first and second shoulders 28, 30 for each slide 12 to be vertically positioned therethrough with first and second portions 66, 68 of the holder 16 encircling the slides 12. Each encircling portion 66, 68 allows the strap 20 of the slides 12 to be rested thereon, thereby, providing a support for the slide 12 and allowing the slide 12 to be remained in a vertical position.

The display hanger 10 further includes a label member 70 integrally connected to the display hanger hook 22. The label member 70 provides convenient surfaces for pictures such as logos or text (including product descriptions) to be printed on, embossed in, or otherwise attached.

In the depicted embodiment, the label member 70 is connected to the side of the display hanger hook 22. Alternatively, the label member 70 could be integrally formed on top of the display hanger hook 22.

The display hanger 10 is made out of one or more materials having suitable properties for a desired application, including strength, weight, rigidity, etc. Plastic is generally preferred. In addition, the display hanger 10 may be manufactured with various dimensions (e.g., body member 14, holder 16, and shoulders 28, 30) to accommodate various sizes of the slide style shoes. It will be appreciated that other designs and configurations could be used for the footwear security display hanger 10, as deemed suitable for a given application factors.

From the foregoing, it will be appreciated that a footwear security display hanger according to the present invention may be used to prevent mix-up of footwear products, as well as for anti-theft, while providing a design that is convenient for merchants to display their goods.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A display hanger for slides, the display hanger comprising:

a body member including a display hanger hook, an elongated central member connected to the display hanger hook and extending downwardly from a lower end of the display hanger hook, and opposed first and second shoulders connected to a lower end of the central member, each of the first and second shoulders extends laterally from the lower end of the central member and then extends downwardly such that a holder space is formed between the first and second shoulders; and a holder integrally connected to the first and second shoulders, the holder having substantially parallel first and second longitudinal side walls and substantially parallel first and second transverse side walls, the longitudinal side walls and transverse side walls integrally connected to each other to form a generally rectangular frame having an open space in the middle;

wherein the holder further includes opposed first and second tabs that extend outwardly from a center of each of the first and second transverse side walls, respectively;

wherein the first and second tabs of the holder are integrally connected to the first and second shoulders, respectively, via a foldline.

2. The display hanger of claim 1, the foldline is configured to allow an upper portion of the holder to be rotated in and out of the holder space.

3. The display hanger of claim 2, wherein, before securing the slides to the display hanger, the holder is rotated out of the holder space such that the holder is perpendicular to the body member and shoulders.

4. The display hanger of claim 2, wherein, when the holder is perpendicular to the body member and shoulders, the open space of the holder is divided into two equal spaces for each slide to be vertically positioned therethrough with first and second support portions of the holder encircling the slides.

5. The display hanger of claim 4, wherein each of the support portions allows a strap of the slide to be rested thereon, thereby, providing a support for the slide and allowing the slide to be remained in a vertical position.

6. The display hanger of claim 1, wherein the display hanger further comprises an elastic cord to keep the slides with the display hanger while a customer tries slides on.

7. The display hanger of claim 6, wherein an aperture is defined in an upper portion of each of the first and second shoulders, through which the elastic cord is inserted and tie the slides to the display hanger.

8. The display hanger of claim 6, wherein the elastic cord is an bungee cord.

9. The display hanger of claim 1, wherein the display hanger is made out of plastic.

10. The display hanger of claim 1, the display hanger further comprises a label member.

11. The display hanger of claim 10, wherein the label member is connected to the display hanger hook.

12. The display hanger of claim 1, wherein the display hanger is a one-piece structure.

13. The display hanger of claim 1, wherein the foldline is crease.

14. The display hanger of claim 1, wherein the holder space is dimensioned such that an upper portion of the holder could be accommodated therewithin.

* * * * *